US012685896B2

(12) United States Patent
Byun

(10) Patent No.: US 12,685,896 B2
(45) Date of Patent: Jul. 21, 2026

(54) MULTI MOVE OUT THIGH

(71) Applicant: NEWTECH WELLNESS CORPORATION, Gimhae-si (KR)

(72) Inventor: Hyun Jung Byun, Busan (KR)

(73) Assignee: NEWTECH WELLNESS CORPORATION, Gimhae-si (KR)

( * ) Notice: Subject to any disclaimer, the term of this patent is extended or adjusted under 35 U.S.C. 154(b) by 92 days.

(21) Appl. No.: 18/939,548

(22) Filed: Nov. 7, 2024

(65) Prior Publication Data

US 2026/0124498 A1 May 7, 2026

(30) Foreign Application Priority Data

Nov. 1, 2024 (KR) ..... 10-2024-0153316

(51) Int. Cl.

| | |
|---|---|
| ***A63B 23/04*** | (2006.01) |
| ***A63B 21/00*** | (2006.01) |
| ***A63B 21/062*** | (2006.01) |
| ***A63B 23/035*** | (2006.01) |

(52) U.S. Cl.

CPC ..... *A63B 23/0488* (2013.01); *A63B 21/063* (2015.10); *A63B 21/154* (2013.01); *A63B 21/4034* (2015.10); *A63B 21/4047* (2015.10); *A63B 23/03541* (2013.01); *A63B 2225/74* (2020.08)

(58) Field of Classification Search

CPC . A63B 23/0488; A63B 21/063; A63B 21/154; A63B 21/4034; A63B 21/4047; A63B 23/03541; A63B 2225/74

See application file for complete search history.

(56) References Cited

U.S. PATENT DOCUMENTS 998,396 A * 7/1911 Rimmer ..... A63B 27/02 182/134
5,277,681 A * 1/1994 Holt ..... A61H 1/02 482/133
5,575,743 A * 11/1996 Jones ..... A63B 21/4047 482/136
5,575,744 A * 11/1996 Jones ..... A63B 21/4039 482/136
6,015,372 A * 1/2000 Steffee ..... A63B 21/0632 452/140
6,090,022 A * 7/2000 Colecchi ..... A61H 1/0292 482/901

(Continued)

FOREIGN PATENT DOCUMENTS

KR 10-0582108 B1 5/2006

*Primary Examiner* — Garrett K Atkinson
(74) *Attorney, Agent, or Firm* — Revolution IP, PLLC

(57) ABSTRACT

A multi move out thigh includes a floor frame supported on a floor, a weight section formed on one side of the floor frame, and internally provided with an accommodation space in which multiple weights are stacked and accommodated, a pivoting section formed on the other side of the floor frame, providing a space for a user to step on, and pivoting in response to an external force applied by the user, a support grip section formed in the floor frame, disposed between the weight section and the pivoting section, and providing a space for the user to grip, and a pivoting selection section that mediates the pivoting section and the weight section so that the weight section is linked by the external force applied to the pivoting section.

6 Claims, 12 Drawing Sheets

(56) References Cited

U.S. PATENT DOCUMENTS

| | | | | |
|---|---|---|---|---|
| 6,117,055 | A * | 9/2000 | Boland | A63B 21/0552 482/121 |
| 6,733,426 | B2 * | 5/2004 | Bussell | A63B 23/0488 482/907 |
| D516,139 | S * | 2/2006 | Panatta | D21/676 |
| 7,141,003 | B2 * | 11/2006 | Wu | A63B 21/00069 482/114 |
| 7,293,825 | B2 * | 11/2007 | Vergara | A47C 9/02 297/283.1 |
| 7,485,078 | B1 * | 2/2009 | Chen | A63B 22/20 482/136 |
| 8,052,217 | B2 * | 11/2011 | Toso | A47C 9/005 297/423.11 |
| 8,562,496 | B2 * | 10/2013 | Webber | A63B 23/0488 482/133 |
| 12,544,614 | B2 * | 2/2026 | Gagnon | A63B 21/04 |
| 2008/0096744 | A1 * | 4/2008 | Perry, Jr. | A61H 1/0218 482/142 |
| 2011/0224058 | A1 * | 9/2011 | Webber | A63B 23/0488 482/133 |
| 2012/0100970 | A9 * | 4/2012 | Webber | A63B 23/0488 482/133 |
| 2014/0057761 | A1 * | 2/2014 | Higgins | A63B 23/1209 482/94 |
| 2016/0324713 | A1 * | 11/2016 | Halperin | A61H 1/0262 |

* cited by examiner (a)

(b)

(a)

(b)

(a)

(b)

(a)

(b)

(a)

(b)

MULTI MOVE OUT THIGH

CROSS-REFERENCE TO RELATED APPLICATION

This application is based on and claims priority under 35 U.S.C. § 119 to Korean Patent Application No. 10-2024-0153316, filed on Nov. 1, 2024, in the Korean Intellectual Property Office, the disclosure of which is incorporated by reference herein in its entirety.

BACKGROUND

The present disclosure relates to a multi move out thigh, and specifically relates to a multi move out thigh for strengthening outer thigh muscles and hip abductors.

In general, exercise equipment commonly found in exercise facilities is divided into upper body training equipment and lower body training equipment. The exercise equipment is equipped with weights that can be selectively adjusted depending on users, and upper or lower body muscles of the users are exercised by the weights.

Lower body exercises using the above-described exercise equipment are used to develop the lower body muscles or to create an elastic, healthy, and slim body, and the lower body is exercised in various ways.

Typical lower body exercise equipment is often used in professional gyms or at home as complex exercise equipment that can also be used for upper body exercises. However, in order to be exclusively used for lower body exercises, exercise equipment for performing one or two types of exercises using one equipment has been released.

Each specialized lower body exercise equipment is used for the above-described lower body exercises including total hip, leg extension, leg curl using feet, inner thigh, outer thigh, hip extension, and hip thrust exercises.

The typical lower body exercise equipment includes a chair whose height can be adjusted from a base, a turntable connected to a footrest, and multiple weights connected to the turntable by wires. A user selects the weight of the weights in accordance with his or her physical condition and inserts a fixing pin to determine the number of the weights. Thereafter, the user sits on the chair of the lower body exercise equipment, and repeatedly performs movements such as lifting and lowering the footrest by using mainly his or her legs. In this manner, the user stimulates muscles in various parts of his or her lower body to develop the muscles.

SUMMARY

The present disclosure aims to provide exercise equipment for strengthening outer thigh muscles and hip abductors.

In addition, the exercise equipment is simply adjusted and set by a user to select whether to exercise both or any one of a right/left side. The present disclosure provides exercise equipment that allows a user to selectively strengthen outer thigh muscles and hip abductors which the user wants to exercise.

According to one embodiment of the present disclosure, there is provided a multi move out thigh for strengthening outer thigh muscles and hip abductors. The multi move out thigh includes a floor frame supported on a floor, having a weight section formed on one side, and internally provided with an accommodation space in which multiple weights are stacked and accommodated; a pivoting section formed on the other side of the floor frame, providing a space for a user to step on, and pivoting in response to an external force applied by the user; a support grip section formed in the floor frame, disposed between the weight section and the pivoting section, and providing a space for the user to grip; and a pivoting selection section that mediates the pivoting section and the weight section so that the weight section is linked by the external force applied to the pivoting section. The pivoting section includes a first swing exercise section pivotably connected to the floor frame and providing a space that an outside of a right thigh of the user leans on while a right foot of the user steps on, and a second swing exercise section pivotably connected to the floor frame and providing a space that an outside of a left thigh of the user leans on while a left foot of the user steps on. The pivoting selection section causes only any one of the first swing exercise section and the second swing exercise section to pivot or causes both the first swing exercise section and the second swing exercise section to simultaneously pivot.

In the multi move out thigh according to the embodiment of the present disclosure, the pivoting selection section may include a first pivoting bar pivotably connected to a first selection pivoting shaft formed in the support grip section, a first linkage roller section connected to the weight section by a first wire while being connected to one side of the first pivoting bar, a second pivoting bar pivotably connected to a second selection pivoting shaft formed in the support grip section, a second linkage roller section connected to the weight section by a second wire while being connected to one side of the second pivoting bar, a selection standing section that stands upright while being fixed to the floor frame and forming a mediating hole penetrating in a width direction of the floor frame, a first selection determination section that determines whether a position of the first pivoting bar is movable relative to the selection standing section depending on whether the first selection determination section is inserted into the mediating hole while being mounted on the first pivoting bar, a second selection determination section that determines whether a position of the second pivoting bar is movable relative to the selection standing section depending on whether the second selection determination section is inserted into the mediating hole while being mounted on the second pivoting bar, and a linkage bar connected to be simultaneously insertable into the first pivoting bar and the second pivoting bar, and determining whether the first pivoting bar and the second pivoting bar are linkable with each other, depending on whether the linkage bar is inserted. The first pivoting bar may be exercisable independently of the second pivoting bar when the first pivoting bar is not connected to the second pivoting bar via the linkage bar. The second pivoting bar may be exercisable independently of the first pivoting bar when the second pivoting bar is not connected to the first pivoting bar via the linkage bar.

In the multi move out thigh according to the embodiment of the present disclosure, the first pivoting bar may include a first parallel section disposed parallel to the floor frame, a 1-1 bent section bent downward from one side end of the first parallel section and having an end to which the first linkage roller section is connected, and a 1-2 bent section bent downward from the other side end of the first parallel section and connected to the first swing exercise section; the 1-1 bent section has a first main linkage hole formed by penetrating the 1-1 bent section; the second pivoting bar includes a second parallel section disposed parallel to the floor frame, a 2-1 bent section bent downward from one side end of the second parallel section and having an end to which the second linkage roller section is connected, and a 2-2 bent section bent downward from the other side end of the second parallel section and connected to the second swing exercise section; the 2-1 bent section has a second main linkage hole formed by penetrating the 2-1 bent section; the linkage bar is simultaneously inserted into the first main linkage hole and the second main linkage hole so that the first pivoting bar and the second pivoting bar are linked while being connected to each other; the first pivoting bar further includes a first linkage determination section connected to the first parallel section and disposed to overlap the selection standing section when the first parallel section is disposed parallel to the floor frame; and the first linkage determination section includes a first selection main body section fixed to an upper side of the first parallel section, and a first cylindrical section guiding a positional movement of the first selection determination section to the mediating hole while being connected to the first selection main body section. The first cylindrical section may have a first cross groove recessed from an outer surface. The first selection determination section may include a first selection insertion bar formed in a bar shape, a first grip head section formed in one side end of the first selection insertion bar in a longitudinal direction, and a first catch section protruding to both sides of the first selection insertion bar in a width direction. In a state where the first selection insertion bar is inserted into the first cylindrical section, when the first catch section is inserted into the first cross groove, the first selection insertion bar may be inserted into the mediating hole so that the first pivoting bar is dependent on the selection standing section, and when the first catch section is detached from the first cross groove, the first selection insertion bar may be released from the mediating hole so that the first pivoting bar is pivotable around the selection standing section. The second pivoting bar may further include a second linkage determination section connected to the second parallel section and disposed to overlap the selection standing section when the second parallel section is disposed parallel to the floor frame. The second linkage determination section may include a second selection main body section fixed to an upper side of the second parallel section, and a second cylindrical section guiding a positional movement of the second selection determination section to the mediating hole while being connected to the second selection main body section. The second cylindrical section may have a second cross groove recessed from an outer surface. The second selection determination section may include a second selection insertion bar formed in a bar shape, a second grip head section formed in one side end of the second selection insertion bar in the longitudinal direction, and a second catch section protruding to both sides of the second selection insertion bar in the width direction. In a state where the second selection insertion bar is inserted into the second cylindrical section, when the second catch section is inserted into the second cross groove, the second selection insertion bar may be inserted into the mediating hole so that the second pivoting bar is dependent on the selection standing section, and when the second catch section is detached from the second cross groove, the second selection insertion bar may be released from the mediating hole so that the second pivoting bar is pivotable with reference to the selection standing section.

In the multi move out thigh according to the embodiment of the present disclosure, the first swing exercise section may include a first swing bar pivotably connected to a first swing pivoting shaft mounted on the floor frame; a first swing footrest section fixed to an upper side of the first swing bar and providing a space for a user's feet to rest on, a first thigh support section that stands upright while being connected to an outer surface of the first swing bar and providing a space for the user's thigh to be supported when the user steps on the first swing footrest section; and a first linkage section having one side connected to the first swing bar and the other side connected to the 1-2 bent section, linked with rotation of the first swing bar, and moving a position of the first pivoting section. The first swing bar may include a first shaft cover section formed in a cylindrical shape and mounted on the first swing pivoting shaft, and a first protrusion section protruding to one side of the first shaft cover section in a circumferential direction. The first linkage section may have one side pivotably connected to the 1-2 bent section and the other side pivotably connected to the first protrusion section, and the first linkage section may move forward or backward in accordance with pivoting of the first protrusion section in response to rotation of the first swing bar. When the first swing exercise section is caused to pivot in an outward direction of the floor frame by the user, the first linkage section may be moved forward to the weight section so that the first pivoting bar pivots in a first rotation direction with reference to the first selection pivoting shaft. The second swing exercise section may include a second swing bar pivotably connected to a second swing pivoting shaft mounted on the floor frame; a second swing footrest section fixed to an upper side of the second swing bar and providing a space for the user's feet to rest on; a second thigh support section that stands upright while being connected to an outer surface of the second swing bar and providing a space for the user's thigh to be supported when the user steps on the second swing footrest section; and a second linkage section having one side connected to the second swing bar and the other side connected to the 2-2 bent section, linked with rotation of the second swing bar, and moving a position of the second pivoting section. The second swing bar may include a second shaft cover section formed in a cylindrical shape and mounted on the second swing pivoting shaft, and a second protrusion section protruding to one side of the second shaft cover section in the circumferential direction. The second linkage section may have one side pivotably connected to the 2-2 bent section and the other side pivotably connected to the second protrusion section, and the second linkage section may move forward or backward in accordance with pivoting of the second protrusion section in response to rotation of the second swing bar. When the second swing exercise section is caused to pivot in the outward direction of the floor frame by the user, the second linkage section may be moved forward to the weight section so that the second pivoting bar pivots in a second rotation direction with reference to the second selection pivoting shaft.

In the multi move out thigh according to the embodiment of the present disclosure, the weight section may include a weight frame formed in a rectangular shape having an empty interior and providing an accommodation space, multiple weights mounted to be liftable on a guide bar that stands upright along a height direction while being accommodated in the accommodation space, a lifting roller section around which a wire is hung while the multiple weights are mediated, a first upper roller piece pivoting in response to traveling of the hung wire while being hung on an upper inner surface of the weight frame and disposed on one side of an upper section of the lifting roller section, a second upper roller piece pivoting in response to the traveling of the hung wire while being hung on a lower inner surface of the weight frame and disposed on the other side of the upper section of the lifting roller section, a first lower roller piece pivoting in response to the traveling of the hung wire while being disposed on the lower inner surface of the weight frame and disposed on a lower side of the first upper roller piece in a vertical direction, a second lower roller piece pivoting in response to the traveling of the hung wire while being disposed on the lower inner surface of the weight frame and disposed on a lower side of the second upper roller piece in the vertical direction, and a wire hung on the roller piece accommodated in the accommodation space. While one side end of the wire may be fixed to the first linkage roller section, the other side end of the wire may be fixed to the second linkage roller section by sequentially passing through the first lower roller piece, the first upper roller piece, the lifting roller section, the second upper roller piece, and the second lower roller piece. The lifting roller section may be raised and lowered in response to a positional movement of the first linkage roller section or the second linkage roller section so that the connected multiple weights are raised and lowered.

The multi move out thigh according to the embodiment of the present disclosure may further include a support footrest section connected to the floor frame while covering an upper side of the first swing pivoting shaft and the second swing pivoting shaft and providing a space for the user to step on, and a support expansion section pivotably connected to an outer end of the support footrest section and expanding the space for the user to step on. The support expansion section may include a box forming section formed in a box shape, and a hinge section formed in one side edge of the box forming section and an outer end of the support footrest section. The support footrest section may include a surrounding section surrounding the first swing pivoting shaft and the second swing pivoting shaft while standing from the floor frame, and a load support section covering an upper side of the surrounding section and transmitting the user's weight to the surrounding section. The support expansion section may pivot at an expansion position where an upper surface of the support expansion section is disposed on the same plane as the load support section, may be moved to an overlapping position where the upper surface of the support expansion section is in contact with the load support section, and may provide a space for the user to sit at the overlapping position. The support grip section may include a first standing bar formed to stand upright on one side of the floor frame in the width direction and on which the first selection pivoting shaft is mounted, a second standing bar formed to stand upright on the other side of the floor frame in the width direction and on which the second selection pivoting shaft is mounted, a first grip piece formed on an upper side of the first standing bar and providing a space for the user to grip, a second grip piece formed on an upper side of the second standing bar and providing a space for the user to grip, and a cross grip bar mediating the upper side of the first standing bar and the upper side of the second standing bar and providing a space for the user to grip. The first grip piece may be threaded while penetrating the first standing bar so that a protrusion height from the first standing bar is changed depending on a position fastened to the first standing bar. The second grip piece may be threaded while penetrating the second standing bar so that a protrusion height from the second standing bar is changed depending on a position fastened to the second standing bar. The first thigh support section may include a first height forming section standing upright from an outer surface of the first swing bar, and a first cushion forming section connected to the first height forming section and providing a cushion while facing the second thigh support section. The first cushion forming section may be connected to be positionally movable along a height direction of the first height forming section. The second thigh support section may include a second height forming section standing upright from an outer surface of the second swing bar, and a second cushion forming section connected to the second height forming section and providing a cushion while facing the second thigh support section. The second cushion forming section may be connected to be positionally movable along the height direction of the second height forming section.

In the multi move out thigh according to the embodiment of the present disclosure, the first selection insertion bar may include a first magnetic section whose end is magnetic. The second selection insertion bar may include a second magnetic section whose end is magnetic. The mediating hole may be formed on a path through which the first selection insertion bar and the second selection insertion bar are inserted, and may have a hole magnetic section forming an attractive force with the first magnetic section or the second magnetic section. The first selection insertion bar or the second selection insertion bar may be completely inserted by magnetism while being inserted into the mediating hole. The multi move out thigh may further include a switch section including a first switch piece formed in the mediating hole and sensing whether the first selection insertion bar is inserted, and a second switch piece formed in the mediating hole and sensing whether the second selection insertion bar is inserted; a lamp section including a first lamp piece formed on a front surface of the first standing bar and emitting light in response to a received signal, and a second lamp piece formed on a front surface of the second standing bar and emitting light in response to a received signal; and a control unit that drives the lamp section in response to sensing of the switch section. The control unit may cause the first lamp piece to emit the light in a first color when the first selection insertion bar is completely inserted into the mediating hole by the first switch piece, and may cause the first lamp piece to stop emitting the light when the first selection insertion bar is released from the mediating hole by the first switch piece. The control unit may cause the second lamp piece to emit the light in the first color when the second selection insertion bar is completely inserted into the mediating hole by the second switch piece, and may cause the second lamp piece to stop emitting the light when the second selection insertion bar is released from the mediating hole by the second switch piece.

According to the present disclosure, the exercise equipment is simply adjusted and set by a user to select whether to exercise both or any one of right/left side. Therefore, the user can selectively strengthen outer thigh muscles and hip abductors which the user wants to exercise.

In addition, the user's convenience is improved by allowing the user to exercise while standing or sitting with a simple operation.

In addition, the user is allowed to check at a glance whether the first swing exercise section for exercising a right thigh and the second swing exercise section for exercising a left thigh can be used for exercise. Therefore, it is possible to prevent the user from being injured due to an unexpected movement in the swing exercise section.

DETAILED DESCRIPTION

Figure 1:
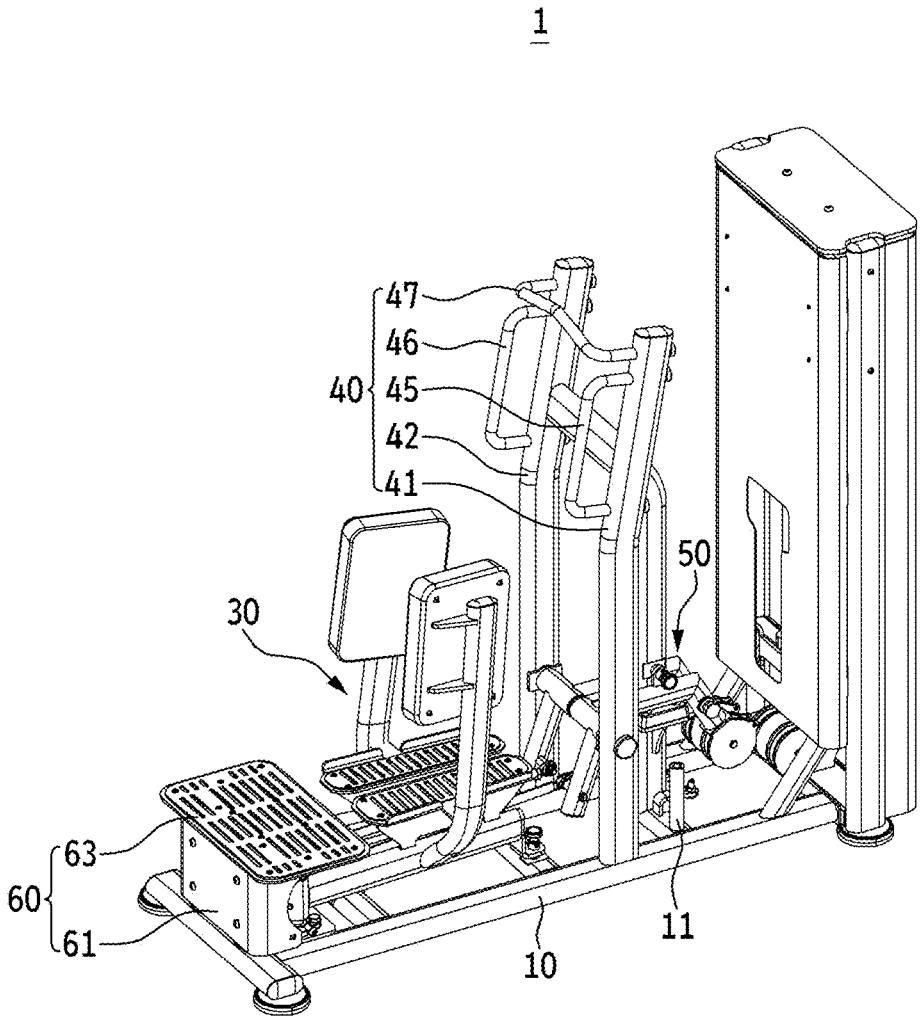
FIG. 1 is a schematic perspective view illustrating a multi move out thigh according to one embodiment of the present disclosure.
Figure 2:
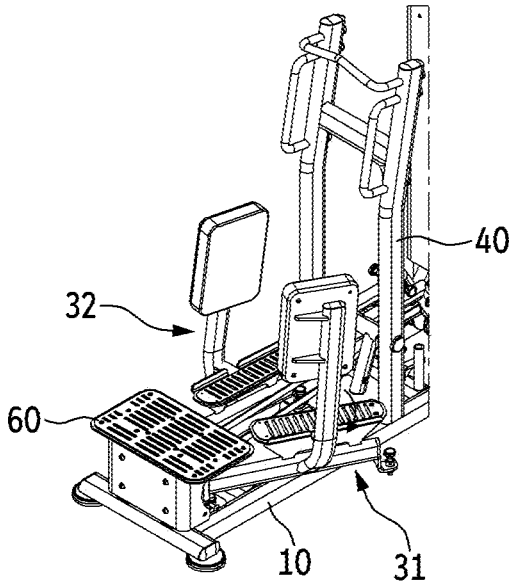
FIGS. 2 to 4 are schematic diagrams for describing an operation of the multi move out thigh according to the embodiment of the present disclosure.
Figure 2:
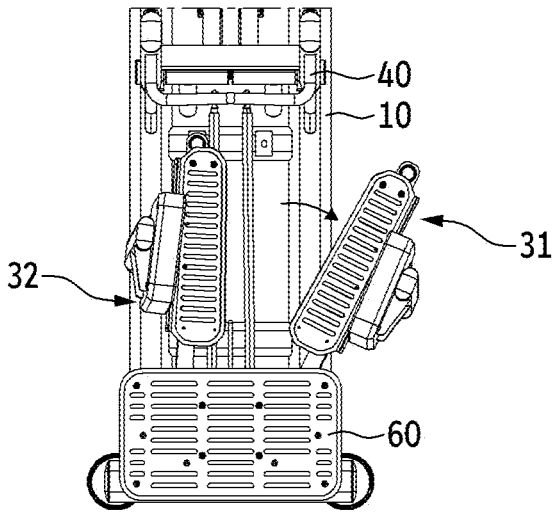
Figure 3:
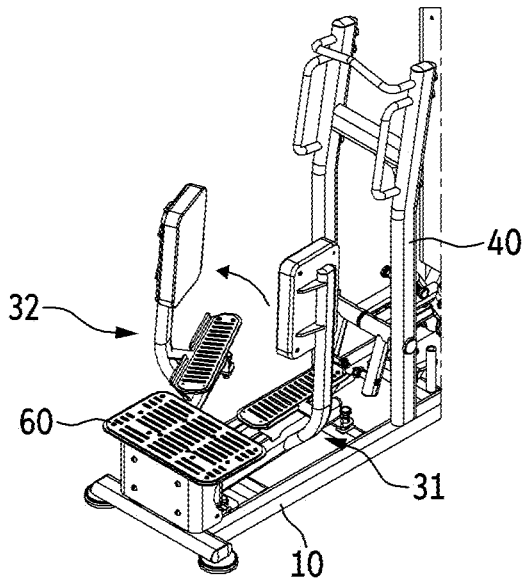
Figure 3:
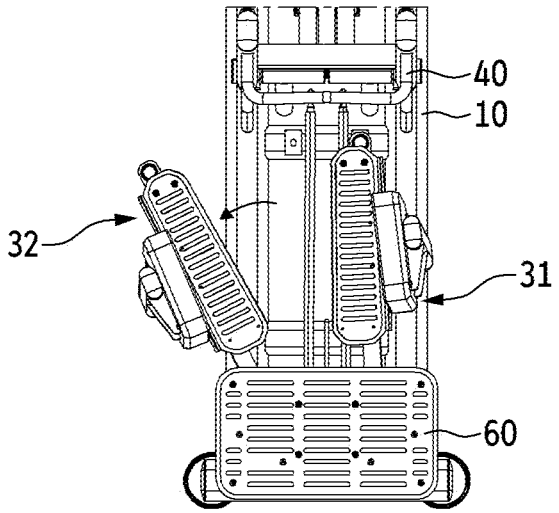
Figure 4:
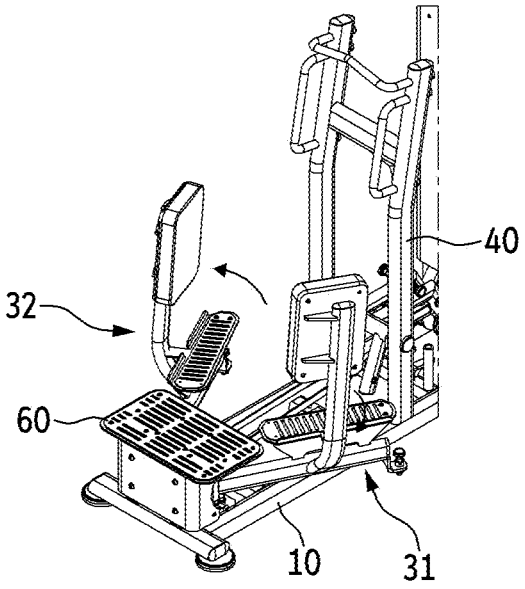
Figure 4:
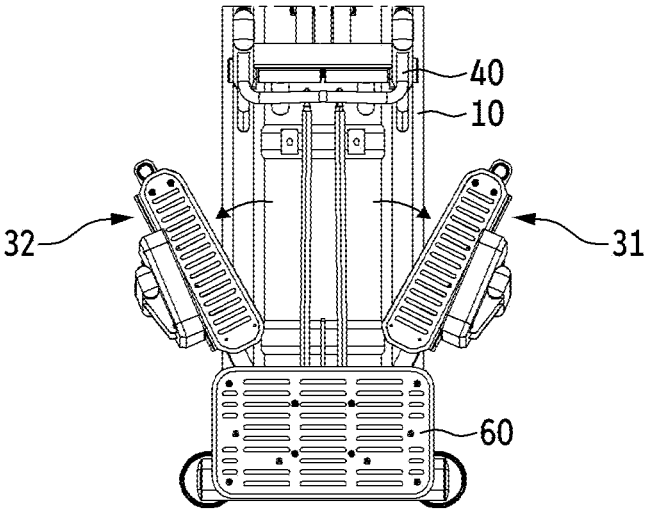

Hereinafter, specific embodiments of the present disclosure will be described in detail with reference to the drawings. However, the concept of the present disclosure is not limited to the presented embodiments, and those skilled in the art who understand the concept of the present disclosure can easily propose other regressive inventions or other embodiments included in the scope of the concept of the present disclosure by adding, changing, deleting other components within the scope of the same concept. However, the other embodiments are also included in the scope of the concept of the present disclosure.

In addition, components having the same function within the scope of the same concept shown in drawings of each embodiment will be described by using the same reference numerals.

FIG. 1 is a schematic perspective view illustrating a multi move out thigh according to one embodiment of the present disclosure, and FIGS. 2A to 4B are schematic diagrams for describing an operation of the multi move out thigh according to the embodiment of the present disclosure.

Referring to FIGS. 1 to 4B, a multi move out thigh (1) according to one embodiment of the present disclosure is exercise equipment for strengthening outer thigh muscles and hip abductors.

The multi move out thigh (1) according to the embodiment of the present disclosure may include a floor frame (10), a weight section (20), a pivoting section (30), a support grip section (40), and a pivoting selection section (50).

The floor frame (10) may be supported on the floor.

The weight section (20) may be formed on one side of the floor frame (10), and may be internally provided with an accommodation space so that multiple weights (22) may be stacked and accommodated.

The pivoting section (30) may be formed on the other side of the floor frame (10), may provide a space for a user to step on, and may pivot in response to an external force applied by the user.

The support grip section (40) may be formed in the floor frame (10), may be disposed between the weight section (20) and the pivoting section (30), and may provide a space for the user to grip.

Specifically, the support grip section (40) may include a first standing bar (41), a second standing bar (42), a first grip piece (45), a second grip piece (46), and a cross grip bar (47).

The first standing bar (41) is formed to stand on one side of the floor frame (10) in a width direction, and a first selection pivoting shaft (S1) may be mounted thereon.

The second standing bar (42) may be formed to stand on the other side of the floor frame (10) in the width direction, and a second selection pivoting shaft (S2) may be mounted thereon.

The first grip piece (45) may be formed on an upper side of the first standing bar (41), and may provide a space for the user to grip.

The second grip piece (46) may be formed on an upper side of the second standing bar (42), and may provide a space for the user to grip.

The cross grip bar (47) may mediate the upper side of the first standing bar (41) and the upper side of the second standing bar (42), and may provide a space for the user to grip.

The pivoting selection section (50) may cause the weight section (20) to be linked by an external force applied to the pivoting section (30) by mediating the pivoting section (30) and the weight section (20).

The pivoting section (30) may include a first swing exercise section (31) and a second swing exercise section (32).

The first swing exercise section (31) may be pivotably connected to the floor frame (10), and may provide a space that an outside of a right thigh of the user leans on while a right foot of the user steps on.

The second swing exercise section (32) may be pivotably connected to the floor frame (10), and may provide a space that an outside of a left thigh of the user leans on while a left foot of the user steps on.

The pivoting selection section (50) may cause only any one of the first swing exercise section (31) and the second swing exercise section (32) to pivot or may cause both the first swing exercise section (31) and the second swing exercise section (32) to simultaneously pivot.

Specifically, when the first swing exercise section (31) is adjusted to be pivotable and the second swing exercise section (32) is adjusted not to be pivotable by the pivoting selection section (50), only the first swing exercise section may be pivotable as illustrated in FIGS. 2A and 2B.

In addition, when the second swing exercise section (32) is adjusted to be pivotable and the first swing exercise section (31) is adjusted not to be pivotable by the pivoting selection section (50), only the second swing exercise section (32) may be pivotable as illustrated in FIGS. 3A and 3B.

When both the first swing exercise section (31) and the second swing exercise section (32) are adjusted to be pivotable by the pivoting selection section (50), the first swing exercise section (31) and the second swing exercise section (32) may simultaneously pivot as illustrated in FIGS. 4A and 4B.

Figure 5:
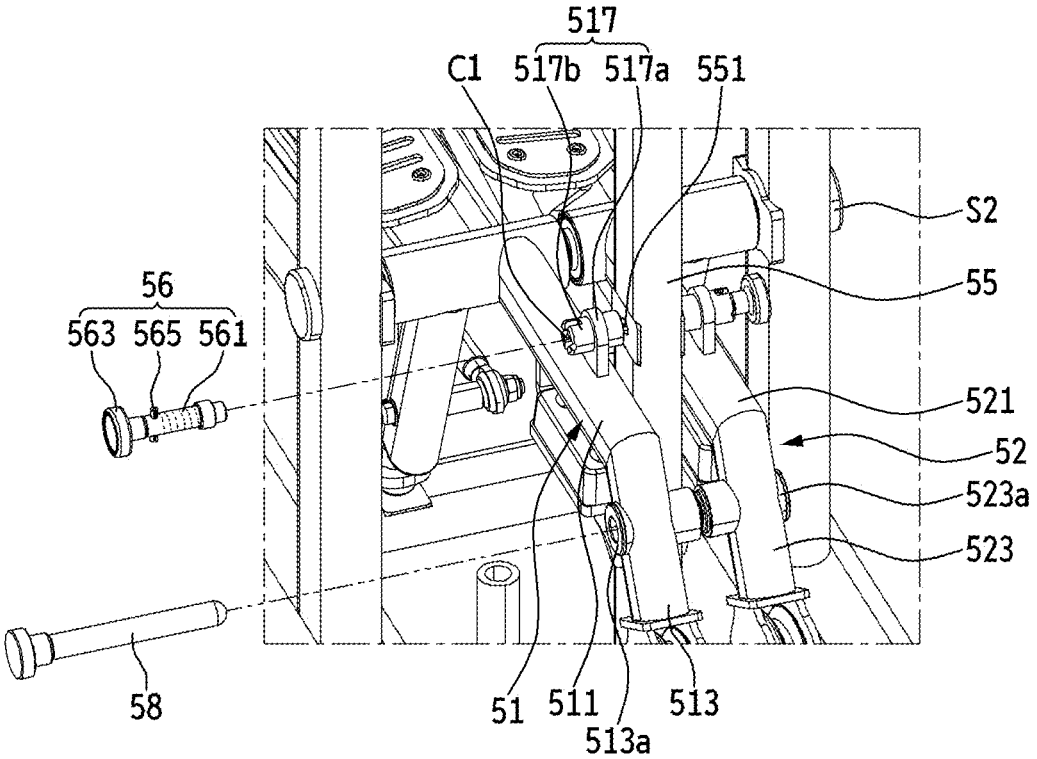
FIGS. 5 and 6 are schematic diagrams for describing a pivoting selection section of the multi move out thigh according to the embodiment of the present disclosure.
Figure 6:
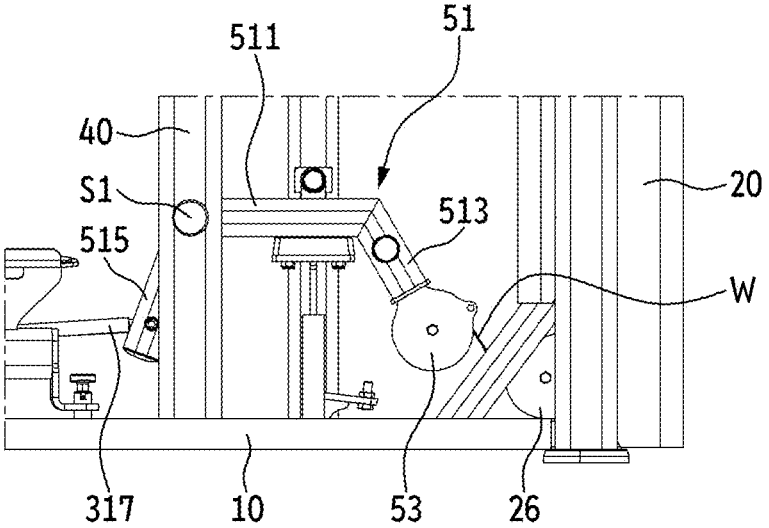
Figure 6:
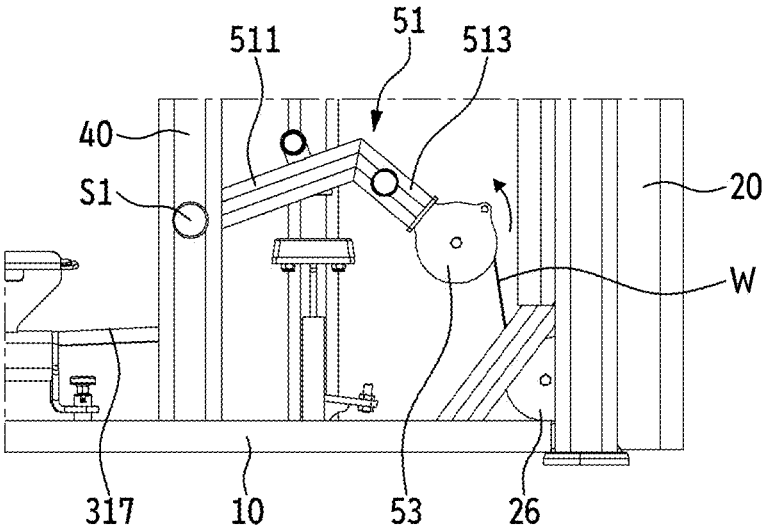

FIGS. 5, 6A, and 6B are schematic diagrams for describing the pivoting selection section of the multi move out thigh according to the embodiment of the present disclosure.

Referring to FIGS. 5, 6A, and 6B, the pivoting selection section (50) of the multi move out thigh (1) according to the embodiment of the present disclosure may include a first pivoting bar (51), a first linkage roller section (53), a second pivoting bar (52), a second linkage roller section (54), a selection standing section (55), a first selection determination section (56), a second selection determination section, and a linkage bar (58).

The first pivoting bar (51) may be pivotably connected to the first selection pivoting shaft (S1) formed in the support grip section (40).

The first linkage roller section (53) may be connected to the weight section (20) by a first wire while being connected to one side of the first pivoting bar (51).

The second pivoting bar (52) may be pivotably connected to the second selection pivoting shaft (S2) formed in the support grip section (40).

The second linkage roller section (54) may be connected to the weight section (20) by a second wire while being connected to one side of the second pivoting bar (52).

The first wire and the second wire refer to one free end and the other free end of the same wire.

The selection standing section (55) may stand upright while being fixed to the floor frame (10), and may form a mediating hole (551) penetrating the floor frame (10) in the width direction.

The first selection determination section (56) may determine whether a position of the first pivoting bar (51) is movable relative to the selection standing section (55) depending on whether the first selection determination section (56) is inserted into the mediating hole (551) while being mounted on the first pivoting bar (51).

The second selection determination section may determine whether a position of the second pivoting bar (52) is movable relative to the selection standing section (55) depending on whether the second selection determination section is inserted into the mediating hole (551) while being mounted on the second pivoting bar (52).

The linkage bar (58) is connected to be simultaneously insertable into the first pivoting bar (51) and the second pivoting bar (52), and may determine whether the first pivoting bar (51) and the second pivoting bar (52) are linkable with each other, depending on whether the linkage bar (58) is inserted.

The first pivoting bar (51) is exercisable independently of the second pivoting bar (52) when the first pivoting bar (51) is not connected to the second pivoting bar (52) via the linkage bar (58).

The second pivoting bar (52) is exercisable independently of the first pivoting bar (51) when the second pivoting bar (52) is not connected to the first pivoting bar (51) via the linkage bar (58).

Specifically, when each of the swing exercise sections (31 and 32) is individually moved as illustrated in FIGS. 2A, 2B, 3A, and 3B, the linkage bar (58) is not simultaneously inserted into the first pivoting bar (51) and the second pivoting bar (52) so that the first pivoting bar (51) and the second pivoting bar (52) are not linked, and when the swing exercise sections (31 and 32) are simultaneously moved as illustrated in FIGS. 4A and 4B, the linkage bar (58) is simultaneously inserted into the first pivoting bar (51) and the second pivoting bar (52) so that the first pivoting bar (51) and the second pivoting bar (52) are linked.

The first pivoting bar (51) of the multi move out thigh (1) according to the embodiment of the present disclosure may include a first parallel section (511) disposed parallel to the floor frame (10), a 1-1 bent section (513) bent downward from one side end of the first parallel section (511) and having an end to which the first linkage roller section (53) is connected, and a 1-2 bent section (515) bent downward from the other side end of the first parallel section (511) and connected to the first swing exercise section (31).

The 1-1 bent section (513) may have a first main linkage hole (513*a*) formed by penetrating the 1-1 bent section (513).

The second pivoting bar (52) may include a second parallel section (521) disposed parallel to the floor frame (10), a 2-1 bent section (523) bent downward from one side end of the second parallel section (521) and having an end to which the second linkage roller section (54) is connected, and a 2-2 bent section bent downward from the other side end of the second parallel section (521) and connected to the second swing exercise section (32).

The 2-1 bent section (523) may have a second main linkage hole (523*a*) formed by penetrating the 2-1 bent section (523).

The linkage bar (58) may be simultaneously inserted into the first main linkage hole (513*a*) and the second main linkage hole (523*a*) so that the first pivoting bar (51) and the second pivoting bar (52) are linked while being connected to each other.

The first pivoting bar (51) may further include a first linkage determination section (517) connected to the first parallel section (511) and disposed to overlap the selection standing section (55) when the first parallel section (511) is disposed parallel to the floor frame (10).

The first linkage determination section (517) may include a first selection main body section (517*a*) and a first cylindrical section (517*b*).

The first selection main body section (517*a*) may be fixed to an upper side of the first parallel section (511).

The first cylindrical section (517*b*) may guide a positional movement of the first selection determination section (56) to the mediating hole (551) while being connected to the first selection main body section (517*a*).

The first cylindrical section (517*b*) may have a first cross groove (C1) recessed from an outer surface.

The first selection determination section (56) may include a first selection insertion bar (561) formed in a bar shape, a first grip head section (563) formed on one side end of the first selection insertion bar (561) in the longitudinal direction, and a first catch section (565) protruding to both sides of the first selection insertion bar (561) in the width direction.

In a state where the first selection insertion bar (561) is inserted into the first cylindrical section (517*b*), when the first catch section (565) is inserted into the first cross groove (C1), the first selection insertion bar (561) may be inserted into the mediating hole (551) so that the first pivoting bar (51) is dependent on the selection standing section (55), and when the first catch section (565) is detached from the first cross groove (C1), the first selection insertion bar (561) may be released from the mediating hole (551) so that the first pivoting bar (51) is pivotable with reference to the selection standing section (55).

The first selection insertion bar (561) may include a first magnetic section whose end is magnetic, and the second selection insertion bar may include a second magnetic section whose end is magnetic.

The mediating hole (551) may be formed on a path through which the first selection insertion bar (561) and the second selection insertion bar are inserted, and may have a hole magnetic section forming an attractive force with the first magnetic section or the second magnetic section.

The first selection insertion bar (561) or the second selection insertion bar may be completely inserted by magnetism while being inserted into the mediating hole (551).

The second pivoting bar (52) may further include a second linkage determination section connected to the second parallel section (521) and disposed to overlap the selection standing section (55) when the second parallel section (521) is disposed parallel to the floor frame (10).

The second linkage determination section may include a second selection main body section and a second cylindrical section.

The second selection main body section may be fixed to an upper side of the second parallel section (521).

The second cylindrical section may guide a positional movement of the second selection determination section to the mediating hole (551) while being connected to the second selection main body section.

The second cylindrical section may have a second cross groove recessed from an outer surface.

The second selection determination section may include a second selection insertion bar formed in a bar shape, a second grip head section formed on one side end of the second selection insertion bar in the longitudinal direction, and a second catch section protruding to both sides of the second selection insertion bar in the width direction.

In a state where the second selection insertion bar is inserted into the second cylindrical section, when the second catch section is inserted into the second cross groove, the second selection insertion bar may be inserted into the mediating hole (551) so that the second pivoting bar (52) is dependent on the selection standing section (55), and when the second catch section is detached from the second cross groove, the second selection insertion bar may be released from the mediating hole (551) so that the second pivoting bar (52) is pivotable with reference to the selection standing section (55).

Meanwhile, the multi move out thigh (1) according to the embodiment of the present disclosure may further include a storage section (11).

The storage section (11) may be formed in the floor frame (10), may be disposed adjacent to the pivoting selection section (50), and may store the linkage bar (58).

The storage section (11) may be formed as a hollow cylinder with an open upper side, and may be formed to have a lower height than the linkage bar (58) so that an upper side is exposed outward while a lower side of the linkage bar (58) is accommodated.

Figure 7:
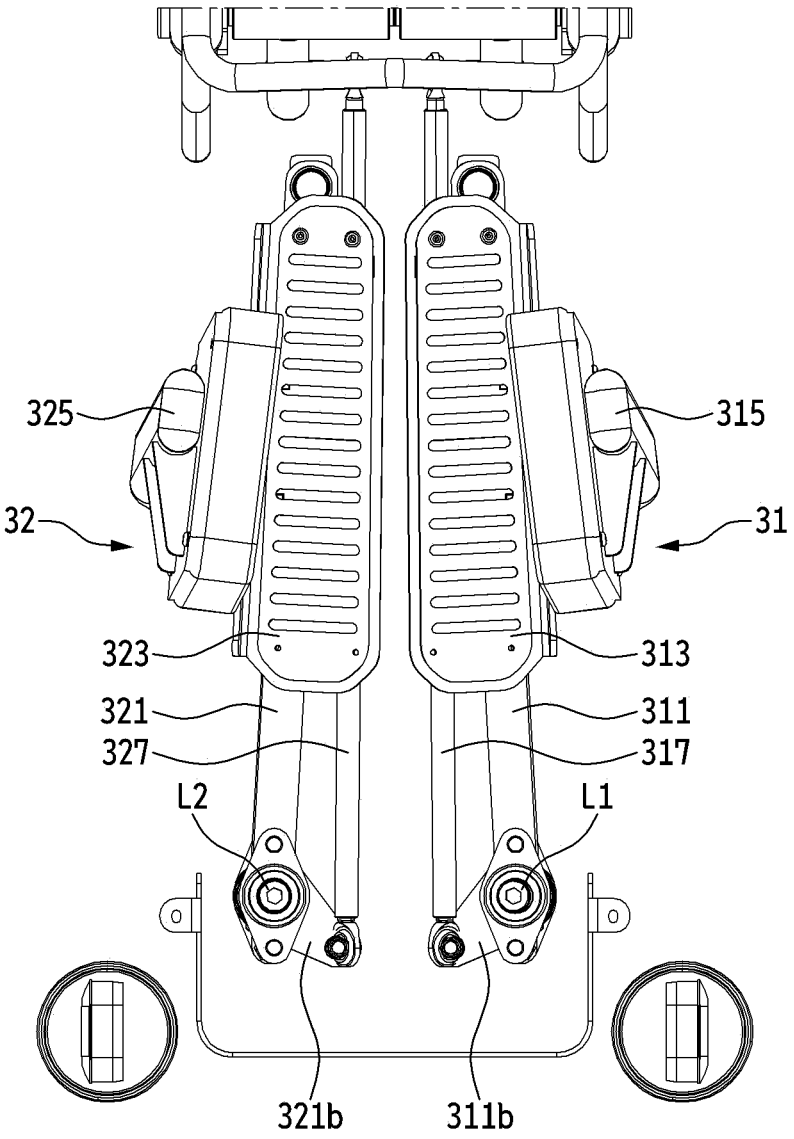
FIGS. 7 and 8 are schematic diagrams for describing a pivoting section of the multi move out thigh according to the embodiment of the present disclosure.
Figure 8:
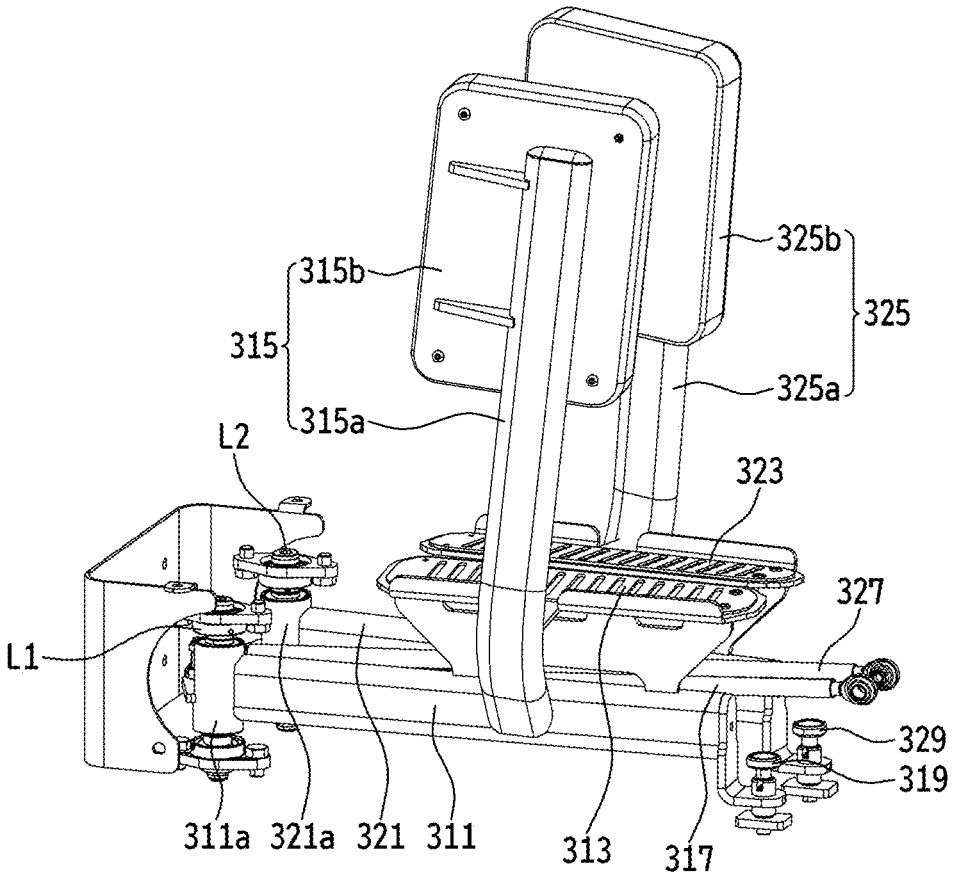

FIGS. 7 and 8 are schematic diagrams for describing the pivoting section of the multi move out thigh according to the embodiment of the present disclosure.

Referring to FIGS. 7 and 8, the first swing exercise section (31) of the multi move out thigh (1) according to the embodiment of the present disclosure may include a first swing bar (311), a first swing footrest section (313), a first thigh support section (315), a first linkage section (317), and a first fluid determination section (319).

The first swing bar (311) may be pivotably connected to a first swing pivoting shaft (L1) mounted on the floor frame (10).

The first swing footrest section (313) may be fixed to an upper side of the first swing bar (311), and may provide a space for the user's feet to rest on.

The first thigh support section (315) may stand upright while being connected to an outer surface of the first swing bar (311), and may provide a space for the user's thigh to be supported when the user steps on the first swing footrest section (313).

The first thigh support section (315) may include a first height forming section (315*a*) and a first cushion forming section (315*b*).

The first height forming section (315*a*) may stand upright from an outer surface of the first swing bar (311).

The first cushion forming section (315*b*) may be connected to the first height forming section (315*a*), and may provide a cushion while facing the second thigh support part (325).

The first linkage section (317) may have one side connected to the first swing bar (311) and the other side connected to the 1-2 bent section (515), may be linked with the rotation of the first swing bar (311), and may move a position of the first pivoting section (30).

While being formed on one side of a free end of the first swing bar (311), the first fluid determination section (319) may determine whether the first swing bar (311) is pivotable around the first swing pivoting shaft (L1) depending on whether the first swing bar (311) is mounted on the floor frame (10).

A mounting structure between the first fluid determination section (319) and the floor frame (10) has the same configuration as a mounting structure between the first selection determination section (56) and the first linkage determination section (517).

The first swing bar (311) may be formed in a cylindrical shape, and may include a first shaft cover section (311*a*) mounted on the first swing pivoting shaft (L1) and a first protrusion section (311*b*) protruding to one side of the first shaft cover section (311*a*) in a circumferential direction.

The first linkage section (317) may have one side pivotably connected to the 1-2 bent section (515) and the other side pivotably connected to the first protrusion section (311*b*), and may move forward or backward in accordance with pivoting of the first protrusion section (311*b*) in response to the rotation of the first swing bar (311).

When the first swing exercise section (31) is caused to pivot in an outward direction of the floor frame (10) by the user, the first linkage section (317) may be moved forward to the weight section (20) (refer to FIG. 6B) so that the first pivoting bar (51) pivot in a first rotation direction with reference to the first selection pivoting shaft (S1).

The second swing exercise section (32) may include a second swing bar (321), a second swing footrest section (323), a second thigh support section (325), a second linkage section (327), and a second fluid determination section (329).

The second swing bar (321) may be pivotably connected to the second swing pivoting shaft (L2) mounted on the floor frame (10).

The second swing footrest section (323) may be fixed to an upper side of the second swing bar (321), and may provide a space for the user's feet to rest on.

The second thigh support section (325) may stand upright while being connected to an outer surface of the second swing bar (321), and may provide a space for the user's thigh to be supported when the user steps on the second swing footrest section (323).

The second thigh support section (325) may include a second height forming section (325*a*) and a second cushion forming section (325*b*).

The second height forming part (325*a*) may stand upright from an outer surface of the second swing bar (321).

The second cushion forming section (325*b*) may be connected to the second height forming section (325*a*), and may provide a cushion while facing the second thigh support part (325).

The second linkage section (327) may have one side connected to the second swing bar (321) and the other side connected to the 2-2 bent section, may be linked with the rotation of the second swing bar (321), and may move a position of the second pivoting section.

While being formed on one side of the free end of the second swing bar (321), the second fluid determination section (329) may determine whether the second swing bar (321) is pivotable around the second swing pivoting shaft (L2) depending on whether the second swing bar (321) is mounted on the floor frame (10).

A mounting structure between the second fluid determination section (329) and the floor frame (10) has the same configuration as a mounting structure between the first selection determination section (56) and the first linkage determination section (517).

The second swing bar (321) may be formed in a cylindrical shape, and may include a second shaft cover section (321*a*) mounted on the second swing pivoting shaft (L2) and a second protrusion section (321*b*) protruding to one side of the second shaft cover section (321*a*) in the circumferential direction.

The second linkage section (327) may have one side pivotably connected to the 2-2 bent section and the other side pivotably connected to the second protrusion section (321*b*), and may move forward or backward in accordance with pivoting of the second protrusion section (321*b*) in response to the rotation of the second swing bar (321).

When the second swing exercise section (32) is caused to pivot in the outward direction of the floor frame (10) by the user, the second linkage section (327) may be moved forward to the weight section (20) so that the second pivoting bar (52) pivot in a second rotation direction with reference to the second selection pivoting shaft (S2).

Figure 9:
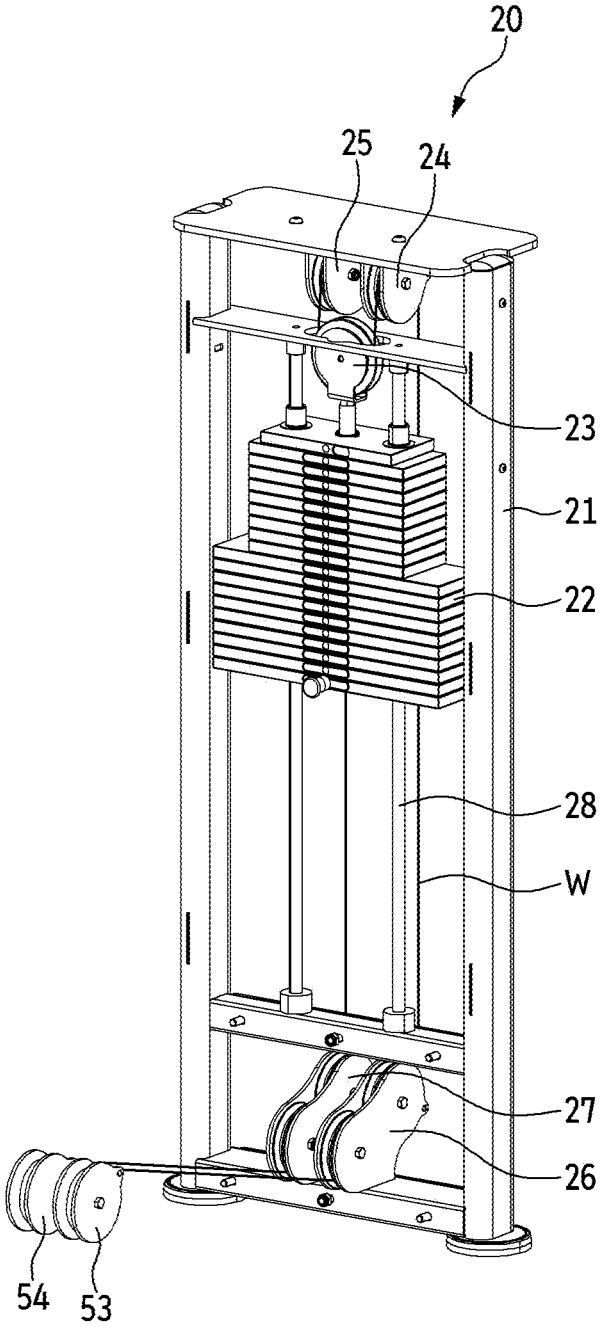
FIG. 9 is a schematic diagram for describing a weight section of the multi move out thigh according to the embodiment of the present disclosure.

FIG. 9 is a schematic diagram for describing the weight section of the multi move out thigh according to the embodiment of the present disclosure.

Referring to FIG. 9, the weight section (20) of the multi move out thigh (1) according to the embodiment of the present disclosure may include a weight frame (21), multiple weights (22), a lifting roller section (23), a first upper roller piece (24), a second upper roller piece (25), a first lower roller piece (26), a second lower roller piece (27), and a wire (W).

The weight frame (21) is formed in a rectangular shape having an empty interior, and provides an accommodation space.

The multiple weights (22) may be mounted to be liftable on the guide bar (28) that stands upright along the height direction while being accommodated in the accommodation space.

The wire (W) may be hung around the lifting roller section (23) while the multiple weights (22) are mediated.

The first upper roller piece (24) may pivot in response to traveling of the hung wire (W) while being hung on an upper inner surface of the weight frame (21), and may be disposed on one side of an upper section of the lifting roller section (23).

The second upper roller piece (25) may pivot in response to traveling of the hung wire (W) while being hung on the upper inner surface of the weight frame (21), and may be disposed on the other side of the upper section of the lifting roller section (23).

The first lower roller piece (26) may pivot in response to traveling of the hung wire (W) while being disposed on a lower inner surface of the weight frame (21), and may be disposed on a lower side of the first upper roller piece (24) in a vertical direction.

The second lower roller piece (27) may pivot in response to traveling of the hung wire (W) while being disposed on the lower inner surface of the weight frame (21), and may be disposed on the lower side of the second upper roller piece (25) in the vertical direction.

The wire (W) may be hung on the roller piece accommodated in the accommodation space.

While one side end of the wire (W) is fixed to the first linkage roller section (53), the other side end of the wire (W) may be fixed to the second linkage roller section (54) by sequentially passing through the first lower roller piece (26), the first upper roller piece (24), the lifting roller section (23), the second upper roller piece (25), and the second lower roller piece (27).

The lifting roller section (23) may be raised and lowered in response to a positional movement of the first linkage roller section (53) or the second linkage roller section (54) so that the connected multiple weights (22) are raised and lowered.

Figure 10:
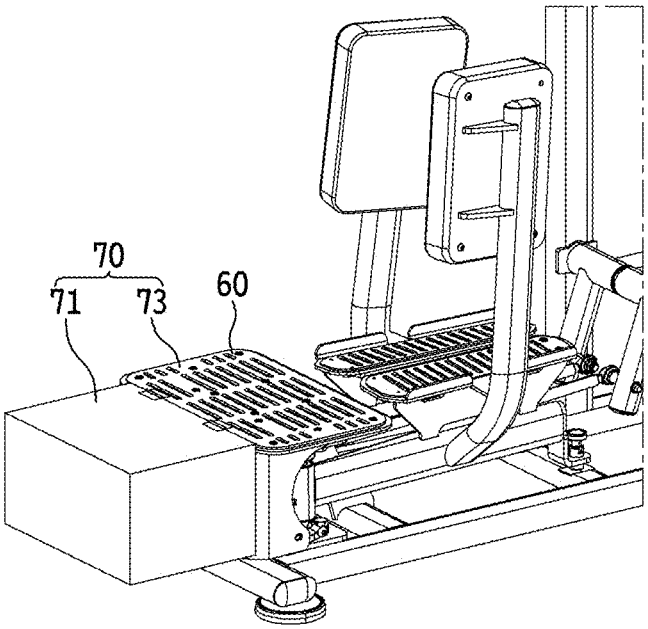
FIGS. 10 and 11 are schematic diagrams for describing a multi move out thigh according to another embodiment of the present disclosure.
Figure 10:
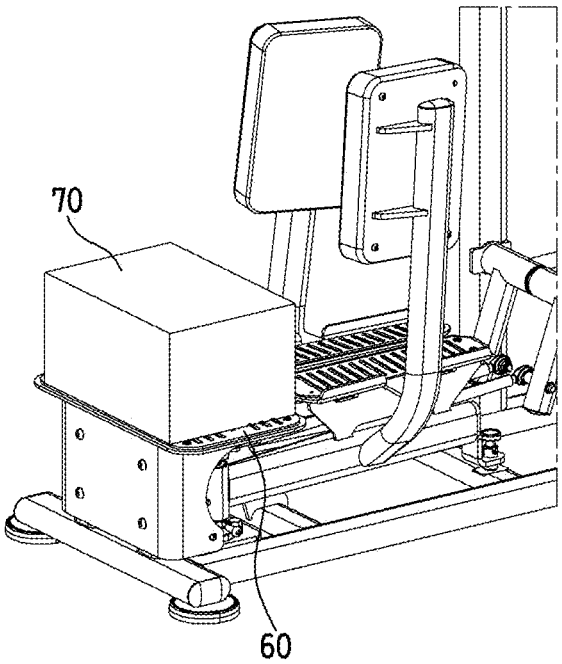
Figure 11:
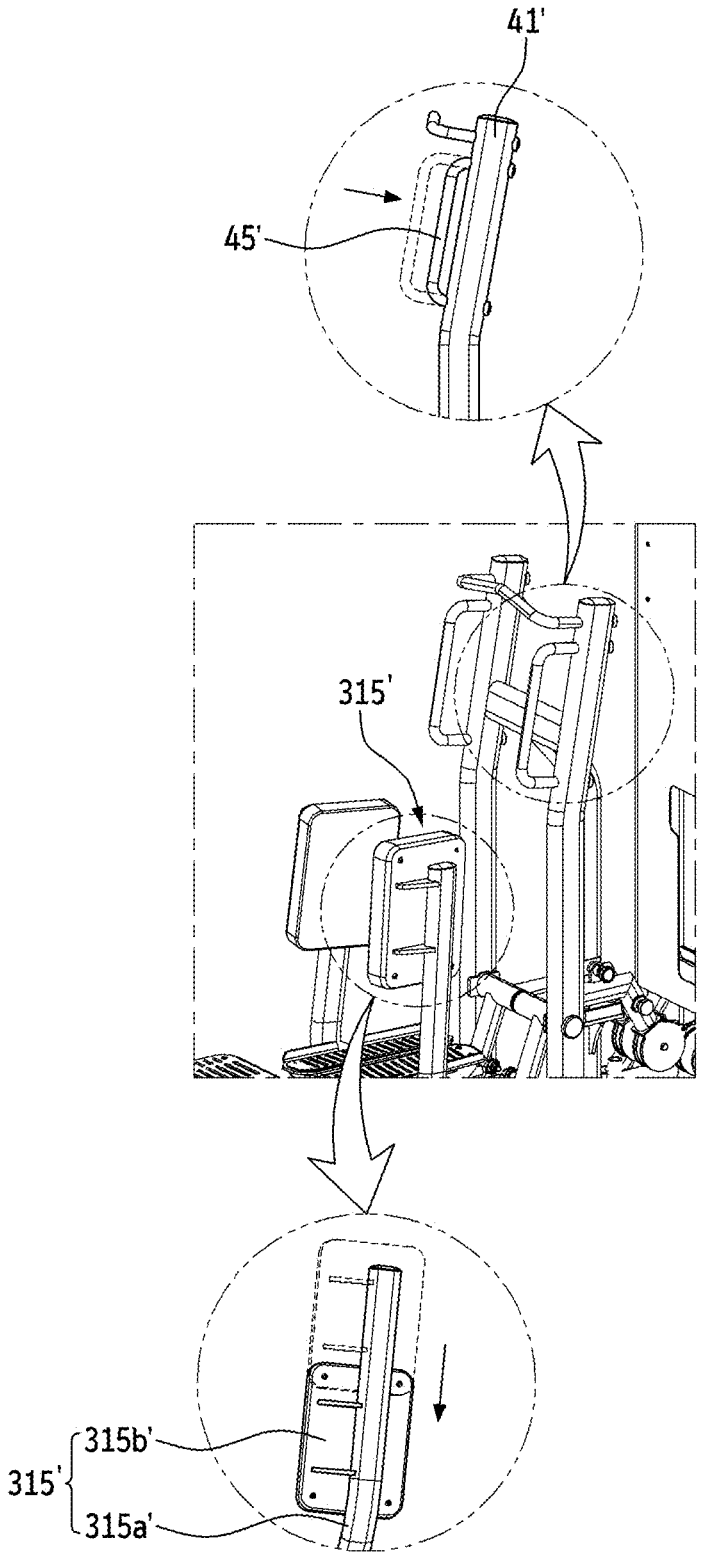

FIGS. 10A, 10B, and 11 are schematic diagrams for describing a multi move out thigh according to another embodiment of the present disclosure.

Referring to FIGS. 10A, 10B, and 11, the multi move out thigh according to another embodiment of the present disclosure has the same configurations and advantageous effects as the multi move out thigh (1) described with reference to FIGS. 1 to 9, except that a support footrest section (60) and a support expansion section (70) are further provided. Therefore, only the support footrest section (60) and the support expansion section (70) will be described below.

The support footrest section (60) of the multi move out thigh (1) according to another embodiment of the present disclosure may be connected to the floor frame (10) while covering an upper side of the first swing pivoting shaft (L1) and the second swing pivoting shaft (L2), and may provide a space for the user to step on.

The support expansion section (70) may be pivotally connected to an outer end of the support footrest section (60), and may expand the space for the user to step on.

The support expansion section (70) may include a box forming section (71) formed in a box shape and a hinge section (73) formed in one edge of the box forming section (71) and an outer end of the support footrest section (60).

The support footrest section (60) may include a surrounding section (61, refer to FIG. 1) and a load support section (63, refer to FIG. 1).

The surrounding section (61) may surround the first swing pivoting shaft (L1) and the second swing pivoting shaft (L2) while standing from the floor frame (10).

The load support section (63) may cover an upper side of the surrounding section (61), and may transmit the user's weight to the surrounding section (61).

The support expansion section (70) may pivot at an expansion position where an upper surface of the support expansion section (70) is disposed on the same plane as the load support section (63), may be moved to an overlapping position where the upper surface of the support expansion section (70) is in contact with the load support section (63), and may provide a space for the user to sit at the overlapping position.

A first grip piece (45') may be threaded while penetrating a first standing bar (41') so that a protrusion height from the first standing bar (41') is changed depending on a position fastened to the first standing bar (41').

A second grip piece may be threaded while penetrating a second standing bar so that a protrusion height from the second standing bar is changed depending on a position fastened to the second standing bar.

A first cushion forming section (315') of a first thigh support section (315') may be connected to be positionally movable along the height direction of a first height forming section (315').

A second cushion forming section may be connected to be positionally movable along the height direction of a second height forming section.

Figure 12:
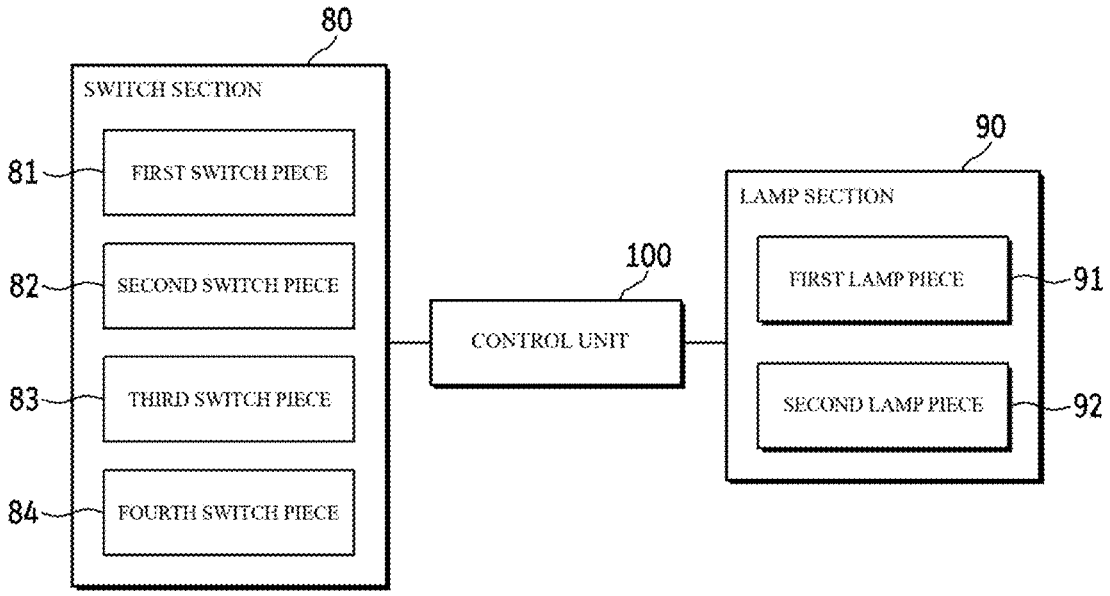
FIG. 12 is a schematic diagram for describing a control unit of a multi move out thigh according to still another embodiment of the present disclosure.

FIG. 12 is a schematic diagram for describing a control unit of a multi move out thigh according to still another embodiment of the present disclosure.

Referring to FIG. 12, the multi move out thigh according to still another embodiment of the present disclosure may further include a switch section (80), a lamp section (90) and a control unit (100).

The switch section (80) may include a first switch piece (81) formed in the mediating hole (551) and sensing whether the first selection insertion bar (561) is inserted, and a second switch piece formed in the mediating hole (551) and sensing whether the second selection insertion bar is inserted.

The lamp section (90) may include a first lamp piece (91) formed on a front surface of the first standing bar (41) and emitting light in response to a received signal, and a second lamp piece formed on a front surface of the second standing bar (42) and emitting light in response to a received signal.

The control unit (100) may drive the lamp section (90) in response to sensing of the switch section (90).

The control unit (100) may cause the first lamp piece (91) to emit the light in a first color when the first selection insertion bar (561) is completely inserted into the mediating hole (551) by the first switch piece (81), and may cause the first lamp piece (91) to stop emitting the light when the first selection insertion bar (561) is released from the mediating hole (551) by the first switch piece (81).

In addition, the control unit (100) may cause the second lamp piece (92) to emit the light in the first color when the second selection insertion bar is completely inserted into the mediating hole (551) by the second switch piece (82), and may cause the second lamp piece (92) to stop emitting the light when the second selection insertion bar is released from the mediating hole (551) by the second switch piece (82).

The switch section (80) may further include a third switch piece (83) sensing whether the linkage bar (58) is inserted into the first main linkage hole (513*a*), and a fourth switch piece (84) sensing whether the linkage bar (58) is inserted into the second main linkage hole (523*a*).

The control unit (100) may cause the first lamp piece (91) and the second lamp piece (92) to emit the light in a second color different from the first color, when the third switch piece (83) and the fourth switch piece (84) sense the insertion of the linkage bar (58).

In addition, the control unit (100) may cause the first lamp piece (91) and the second lamp piece (92) to alternately light in the first color and the second color, when only one of the third switch piece (83) and the fourth switch piece (84) senses the insertion of the linkage bar (58).

Meanwhile, the control unit (100) may drive the lamp section (90) in response to sensing of the switch section (80), and when accuracy, precision, and recall of the sensor fall below preset values, an alarm may be issued to a manager to notify the manager that the sensor needs to be replaced.

Hereinafter, processes of calculating the accuracy, the precision, and the recall will be described in more detail.

The accuracy means a ratio of the number of times that the sensor (one of the respective sensors sensing the insertion of the first selection insertion bar (561), the second selection insertion bar, and the linkage bar (58)) correctly determines the insertion, and may be defined as [Mathematical Expression 1] below.

$$(\text{Accuracy}) = \frac{\text{True Positives} + \text{True Negatives}}{\text{Total Predictions}} \quad \text{[Mathematical Expression 1]}$$

Here, true positives (TP) mean the number of times that the sensor correctly recognizes the insertion bar when correctly inserted, true negatives (TN) mean the number of times that the sensor correctly detects the insertion bar when not inserted, false positives (FP) mean the number of times that the sensor incorrectly detects the insertion bar when not inserted, false negatives (FN) mean the number of times that the sensor does not detect the insertion bar when inserted, and total predictions (total number of determinations) mean TP+TN+FP+FN, respectively.

In addition, the precision means a ratio of correct cases where the insertion bar is actually inserted when the sensor detects the insertion, and may be expressed as [Mathematical Expression 2] below. The recall means a ratio of cases where the sensor correctly detects the insertion when the insertion bar is actually inserted, and may be expressed as [Mathematical Expression 3] below.

$$(\text{Precision}) = \frac{\text{True Positives}}{\text{True Positives} + \text{False Positives}} \quad \text{[Mathematical Expression 2]}$$

$$(\text{Recall}) = \frac{\text{True Positives}}{\text{True Positives} + \text{False Negatives}} \quad \text{[Mathematical Expression 3]}$$

Here, the precision and the recall may be integrated and used as a single index, and an integrated index (FS) using a harmonic mean of the precision and the recall may be used as in [Mathematical Expression 4] below.

$$(FS) = 2 \times \frac{\text{Precision} \times \text{Recall}}{\text{Precision} + \text{Recall}} \quad \text{[Mathematical Expression 4]}$$

As described above, the control unit (100) may accurately determine whether the sensor is faulty. When the accuracy and the integrated index simultaneously fall below a preset value to prevent indiscriminate fault diagnosis, the control unit may determine that the sensor is faulty, and may issue an alarm to a manager so that the sensor needs to be replaced.

Although the configurations and features of the present disclosure have been described above with reference to the embodiments according to the present disclosure, the present disclosure is not limited thereto. It will be apparent to those skilled in the art to which the present disclosure pertains that various changes or modifications can be made within the concept and the scope of the present disclosure. Therefore, the changes or the modifications fall within the scope of the appended claims.

The invention claimed is:

1. A multi move out thigh for strengthening outer thigh muscles and hip abductors, comprising:

a floor frame supported on a floor;

a weight section formed on one side of the floor frame, and internally provided with an accommodation space in which multiple weights are stacked and accommodated;

a pivoting section formed on the other side of the floor frame, providing a space for a user to step on, and pivoting in response to an external force applied by the user;

a support grip section formed in the floor frame, disposed between the weight section and the pivoting section, and providing a space for the user to grip; and a pivoting selection section that mediates the pivoting section and the weight section so that the weight section is linked by the external force applied to the pivoting section, wherein the pivoting section includes a first swing exercise section pivotably connected to the floor frame and providing a space that an outside of a right thigh of the user leans on while a right foot of the user steps on, and a second swing exercise section pivotably connected to the floor frame and providing a space that an outside of a left thigh of the user leans on while a left foot of the user steps on, and the pivoting selection section causes only any one of the first swing exercise section and the second swing exercise section to pivot or causes both the first swing exercise section and the second swing exercise section to simultaneously pivot.

2. The multi move out thigh of claim 1, wherein the pivoting selection section includes a first pivoting bar pivotably connected to a first selection pivoting shaft formed in the support grip section, a first linkage roller section connected to the weight section by a first wire while being connected to one side of the first pivoting bar, a second pivoting bar pivotably connected to a second selection pivoting shaft formed in the support grip section; a second linkage roller section connected to the weight section by a second wire while being connected to one side of the second pivoting bar, a selection standing section standing upright while being fixed to the floor frame and forming a mediating hole penetrating in a width direction of the floor frame; a first selection determination section that determines whether a position of the first pivoting bar is movable relative to the selection standing section depending on whether the first selection determination section is inserted into the mediating hole while being mounted on the first pivoting bar; a second selection determination section that determines whether a position of the second pivoting bar is movable relative to the selection standing section depending on whether the second selection determination section is inserted into the mediating hole while being mounted on the second pivoting bar; and a linkage bar connected to be simultaneously insertable into the first pivoting bar and the second pivoting bar, and determining whether the first pivoting bar and the second pivoting bar are linkable with each other, depending on whether the linkage bar is inserted, the first pivoting bar being exercisable independently of the second pivoting bar when the first pivoting bar is not connected to the second pivoting bar via the linkage bar, and the second pivoting bar being exercisable independently of the first pivoting bar when the second pivoting bar is not connected to the first pivoting bar via the linkage bar.

3. The multi move out thigh of claim 2, wherein the first pivoting bar includes a first parallel section disposed parallel to the floor frame, a 1-1 bent section bent downward from one side end of the first parallel section and having an end to which the first linkage roller section is connected, and a 1-2 bent section bent downward from the other side end of the first parallel section and connected to the first swing exercise section; the 1-1 bent section has a first main linkage hole formed by penetrating the 1-1 bent section; the second pivoting bar includes a second parallel section disposed parallel to the floor frame, a 2-1 bent section bent downward from one side end of the second parallel section and having an end to which the second linkage roller section is connected, and a 2-2 bent section bent downward from the other side end of the second parallel section and connected to the second swing exercise section; the 2-1 bent section has a second main linkage hole formed by penetrating the 2-1 bent section; the linkage bar is simultaneously inserted into the first main linkage hole and the second main linkage hole so that the first pivoting bar and the second pivoting bar are linked while being connected to each other; the first pivoting bar further includes a first linkage determination section connected to the first parallel section and disposed to overlap the selection standing section when the first parallel section is disposed parallel to the floor frame; the first linkage determination section includes a first selection main body section fixed to an upper side of the first parallel section, and a first cylindrical section guiding a positional movement of the first selection determination section to the mediating hole while being connected to the first selection main body section; the first cylindrical section has a first cross groove recessed from an outer surface; the first selection determination section includes a first selection insertion bar formed in a bar shape, a first grip head section formed in one side end of the first selection insertion bar in a longitudinal direction, and a first catch section protruding to both sides of the first selection insertion bar in a width direction, in a state where the first selection insertion bar is inserted into the first cylindrical section; when the first catch section is inserted into the first cross groove, the first selection insertion bar is inserted into the mediating hole so that the first pivoting bar is dependent on the selection standing section, and when the first catch section is detached from the first cross groove, the first selection insertion bar is released from the mediating hole so that the first pivoting bar is pivotable around the selection standing section; the second pivoting bar further includes a second linkage determination section connected to the second parallel section and disposed to overlap the selection standing section when the second parallel section is disposed parallel to the floor frame; the second linkage determination section includes a second selection main body section fixed to an upper side of the second parallel section, and a second cylindrical section guiding a positional movement of the second selection determination section to the mediating hole while being connected to the second selection main body section; the second cylindrical section has a second cross groove recessed from an outer surface; the second selection determination section includes a second selection insertion bar formed in a bar shape, a second grip head section formed in one side end of the second selection insertion bar in the longitudinal direction, and a second catch section protruding to both sides of the second selection insertion bar in the width direction; and in a state where the second selection insertion bar is inserted into the second cylindrical section, when the second catch section is inserted into the second cross groove, the second selection insertion bar is inserted into the mediating hole so that the second pivoting bar is dependent on the selection standing section, and when the second catch section is detached from the second cross groove, the second selection insertion bar is released from the mediating hole so that the second pivoting bar is pivotable with reference to the selection standing section.

4. The multi move out thigh of claim 3, wherein the first swing exercise section includes a first swing bar pivotably connected to a first swing pivoting shaft mounted on the floor frame, a first swing footrest section fixed to an upper side of the first swing bar and providing a space for a user's feet to rest on, a first thigh support section standing upright while being connected to an outer surface of the first swing bar and providing a space for the user's thigh to be supported when the user steps on the first swing footrest section, and a first linkage section having one side connected to the first swing bar and the other side connected to the 1-2 bent section, linked with rotation of the first swing bar, and moving a position of the first pivoting section; the first swing bar includes a first shaft cover section formed in a cylindrical shape and mounted on the first swing pivoting shaft, and a first protrusion section protruding to one side of the first shaft cover section in a circumferential direction; the first linkage section has one side pivotably connected to the 1-2 bent section and the other side pivotably connected to the first protrusion section, and moves forward or backward in accordance with pivoting of the first protrusion section in response to rotation of the first swing bar; when the first swing exercise section is caused to pivot in an outward direction of the floor frame by the user, the first linkage section is moved forward to the weight section so that the first pivoting bar pivots in a first rotation direction with reference to the first selection pivoting shaft; the second swing exercise section includes a second swing bar pivotably connected to a second swing pivoting shaft mounted on the floor frame, a second swing footrest section fixed to an upper side of the second swing bar and providing a space for the user's feet to rest on, a second thigh support section standing upright while being connected to an outer surface of the second swing bar and providing a space for the user's thigh to be supported when the user steps on the second swing footrest section, and a second linkage section having one side connected to the second swing bar and the other side connected to the 2-2 bent section, linked with rotation of the second swing bar, and moving a position of the second pivoting section; the second swing bar includes a second shaft cover section formed in a cylindrical shape and mounted on the second swing pivoting shaft, and a second protrusion section protruding to one side of the second shaft cover section in the circumferential direction; the second linkage section has one side pivotably connected to the 2-2 bent section and the other side pivotably connected to the second protrusion section, and moves forward or backward in accordance with pivoting of the second protrusion section in response to rotation of the second swing bar; and when the second swing exercise section is caused to pivot in the outward direction of the floor frame by the user, the second linkage section is moved forward to the weight section so that the second pivoting bar pivots in a second rotation direction with reference to the second selection pivoting shaft.

5. The multi move out thigh of claim 4, wherein the weight section includes a weight frame formed in a rectangular shape having an empty interior and providing an accommodation space, multiple weights mounted to be liftable on a guide bar standing along a height direction while being accommodated in the accommodation space, a lifting roller section around which a wire is hung while the multiple weights are mediated, a first upper roller piece pivoting in response to traveling of the hung wire while being hung on an upper inner surface of the weight frame and disposed on one side of an upper section of the lifting roller section, a second upper roller piece pivoting in response to the traveling of the hung wire while being hung on a lower inner surface of the weight frame and disposed on the other side of the upper section of the lifting roller section, a first lower roller piece pivoting in response to the traveling of the hung wire while being disposed on the lower inner surface of the weight frame and disposed on a lower side of the first upper roller piece in a vertical direction, a second lower roller piece pivoting in response to the traveling of the hung wire while being disposed on the lower inner surface of the weight frame and disposed on a lower side of the second upper roller piece in the vertical direction, and a wire hung on the roller piece accommodated in the accommodation space; while one side end of the wire is fixed to the first linkage roller section, the other side end of the wire is fixed to the second linkage roller section by sequentially passing through the first lower roller piece, the first upper roller piece, the lifting roller section, the second upper roller piece, and the second lower roller piece; and the lifting roller section is raised and lowered in response to a positional movement of the first linkage roller section or the second linkage roller section so that the connected multiple weights are raised and lowered.

6. The multi move out thigh of claim 5, further comprising:

a support footrest section connected to the floor frame while covering an upper side of the first swing pivoting shaft and the second swing pivoting shaft and providing a space for the user to step on; and a support expansion section pivotably connected to an outer end of the support footrest section and expanding the space for the user to step on, wherein the support expansion section includes a box forming section formed in a box shape, and a hinge section formed in one side edge of the box forming section and an outer end of the support footrest section; the support footrest section includes a surrounding section surrounding the first swing pivoting shaft and the second swing pivoting shaft while standing from the floor frame, and a load support section covering an upper side of the surrounding section and transmitting the user's weight to the surrounding section; the support expansion section pivots at an expansion position where an upper surface of the support expansion section is disposed on the same plane as the load support section, is moved to an overlapping position where the upper surface of the support expansion section is in contact with the load support section, and provides a space for the user to sit at the overlapping position; the support grip section includes a first standing bar formed to stand upright on one side of the floor frame in the width direction and on which the first selection pivoting shaft is mounted, a second standing bar formed to stand upright on the other side of the floor frame in the width direction and on which the second selection pivoting shaft is mounted, a first grip piece formed on an upper side of the first standing bar and providing a space for the user to grip, a second grip piece formed on an upper side of the second standing bar and providing a space for the user to grip, and a cross grip bar mediating the upper side of the first standing bar and the upper side of the second standing bar and providing a space for the user to grip; the first grip piece is threaded while penetrating the first standing bar so that a protrusion height from the first standing bar is changed depending on a position fastened to the first standing bar; the second grip piece is threaded while penetrating the second standing bar so that a protrusion height from the second standing bar is changed depending on a position fastened to the second standing bar; the first thigh support section includes a first height forming section standing from an outer surface of the first swing bar, and a first cushion forming section connected to the first height forming section and providing a cushion while facing the second thigh support section; the first cushion forming section is connected to be positionally movable along a height direction of the first height forming section; the second thigh support section includes a second height forming section standing from an outer surface of the second swing bar, and a second cushion forming section connected to the second height forming section and providing a cushion while facing the second thigh support section; the second cushion forming section is connected to be positionally movable along the height direction of the second height forming section; the first selection insertion bar includes a first magnetic section whose end is magnetic; the second selection insertion bar includes a second magnetic section whose end is magnetic; the mediating hole is formed on a path through which the first selection insertion bar and the second selection insertion bar are inserted, and has a hole magnetic section forming an attractive force with the first magnetic section or the second magnetic section; the first selection insertion bar or the second selection insertion bar is completely inserted by magnetism while being inserted into the mediating hole; the multi move out thigh further comprises a switch section including a first switch piece formed in the mediating hole and sensing whether the first selection insertion bar is inserted, and a second switch piece formed in the mediating hole and sensing whether the second selection insertion bar is inserted, a lamp section including a first lamp piece formed on a front surface of the first standing bar and emitting light in response to a received signal, and a second lamp piece formed on a front surface of the second standing bar and emitting light in response to a received signal, and a control unit that drives the lamp section in response to sensing of the switch section; the control unit causes the first lamp piece to emit the light in a first color when the first selection insertion bar is completely inserted into the mediating hole by the first switch piece, and causes the first lamp piece to stop emitting the light when the first selection insertion bar is released from the mediating hole by the first switch piece; and the control unit causes the second lamp piece to emit the light in the first color when the second selection insertion bar is completely inserted into the mediating hole by the second switch piece, and causes the second lamp piece to stop emitting the light when the second selection insertion bar is released from the mediating hole by the second switch piece.

* * * * *